United States Patent [19]

Hoff

[11] Patent Number: 4,735,425

[45] Date of Patent: Apr. 5, 1988

[54] GOLF BAG/CART COMBINATION

[76] Inventor: Charles V. Hoff, 6755 SW. Sandburg St., Tigard, Oreg. 97223

[21] Appl. No.: 859,376

[22] Filed: May 5, 1986

[51] Int. Cl.[4] ..... B62B 1/12

[52] U.S. Cl. ..... 280/47.18; 280/47.24; 280/DIG. 6

[58] Field of Search ..... 280/40, 646, 652, 655, 280/47.17, 47.18, 47.24, DIG. 5, DIG. 6

[56] References Cited

U.S. PATENT DOCUMENTS

| | | | |
|---|---|---|---|
| 2,687,895 | 8/1954 | Rutledge | 280/DIG. 6 |
| 2,885,215 | 5/1959 | Williamson | 280/DIG. 6 |
| 3,907,056 | 9/1975 | Thomas, III | 280/DIG. 5 |

FOREIGN PATENT DOCUMENTS

| | | | |
|---|---|---|---|
| 722429 | 1/1955 | United Kingdom | 280/DIG. 6 |

*Primary Examiner*—John J. Love
*Assistant Examiner*—Richard Camby
*Attorney, Agent, or Firm*—Robert L. Harrington

[57] ABSTRACT

A golf bag having a support frame which includes a rigid spine member, Key way slots are provided at upper and lower positions in the spine member for receiving headed studs. Headed studs adaptable for attachment in the key way of the spine member are provided in a wheel assembly and a handle assembly. The handle and wheel assemblies can be separated from the bag for convenient storage and when it is desired to carry the bag or load the bag onto a powered cart. As desired, the wheel assembly and handle assembly can be attached to the bag to provide the bag with a pulling cart. Locking and stabilizing features are provided to insure a secure attachment.

6 Claims, 2 Drawing Sheets

GOLF BAG/CART COMBINATION

FIELD OF INVENTION

This invention relates to a golf bag having wheels and a handle which function as a pulling cart, the wheels and handle being removable to facilitate storage and to provide the golfer with the alternate choice of carrying the bag.

BACKGROUND OF INVENTION

Some golfers prefer to carry their golf bag, some prefer to mount the golf bag on a pulling cart to be pulled by the golfer as he walks the fairway, and some prefer to load the golf bag into a powered riding cart. Golf bags, powered carts and pulling carts are available to accomodate any of these preferences.

However, in many occasions, the golfer either switches his preference because of varying circumstances, e.g., the course is too hilly for walking and or carrying the golf bag, or he is required to switch because of course regulations (e.g. the course is too wet for carts, or powered carts are mandated to speed up play). Thus many golfers have golf bags that can be carried or loaded onto a powered cart, and they also have pulling carts on which the golf bag can be mounted, e.g., with straps.

The combination of golf bag and pulling cart presents a number of problems. The cart is generally constructed of a rigid metal frame with straps (for strapping the golf bag to it), wheels and a handle. The cart is easy to pull down the fairway and performs very adequately for that purpose. However, the combination bag and cart are heavy and bulky (even though the cart is often made partially collapsible). Loading the cart and bag when strapped together into the trunk of an automobile can be difficult. It certainly consumes most or all of the space in the average car trunk and in smaller cars, the trunk space is not big enough for both the cart and golf bag. Separating the two items means strapping and unstrapping the bag from the cart each time the golfer goes golfing.

SUMMARY OF THE INVENTION

The present invention, to a large extent, solves the above problems. In the preferred embodiment, a light weight bag of generally typical construction is provided with rigid spine or webb forming an integral part of the bag's frame. The rigid spine extends from near the top of the bag to the bottom and for the most part is covered by whatever fabric material makes up the outside of the bag.

A handle member has a base end provided with interlock means. A mating interlock means is formed into the rigid spine member near the top of the bag, and is exposed through the covering for engagement by the interlock means of the handle member.

A wheel assembly includes a pair of wheels. The wheels are mounted on the ends of a pair of elongated legs that are pivotally joined at the ends opposite the wheels. An interlock means is provided at the juncture of the legs. A second mating interlock means is formed in the rigid spine member toward the bottom of the bag. This second mating interlock means is exposed through the covering and interconnects with the interlock means of the wheel assembly.

With the wheel assembly and handle fastened to the rigid spine of the bag, the bag wheels and handle become a single unit and function as a bag, pull cart combination. With the handle and wheel assembly disconnected, the bag is conveniently carried or loaded on a powered riding cart. The wheels collapse and together with the handle can be tucked away in the smallest of car trunks. The major bulk of a pull cart is eliminated, i.e., the elongated brace member to which the wheels and handle of a conventional pull cart are attached.

The invention will be more fully appreciated upon reference to the detailed description and drawings that follow.

DRAWINGS DESCRIPTION

Figure 1:
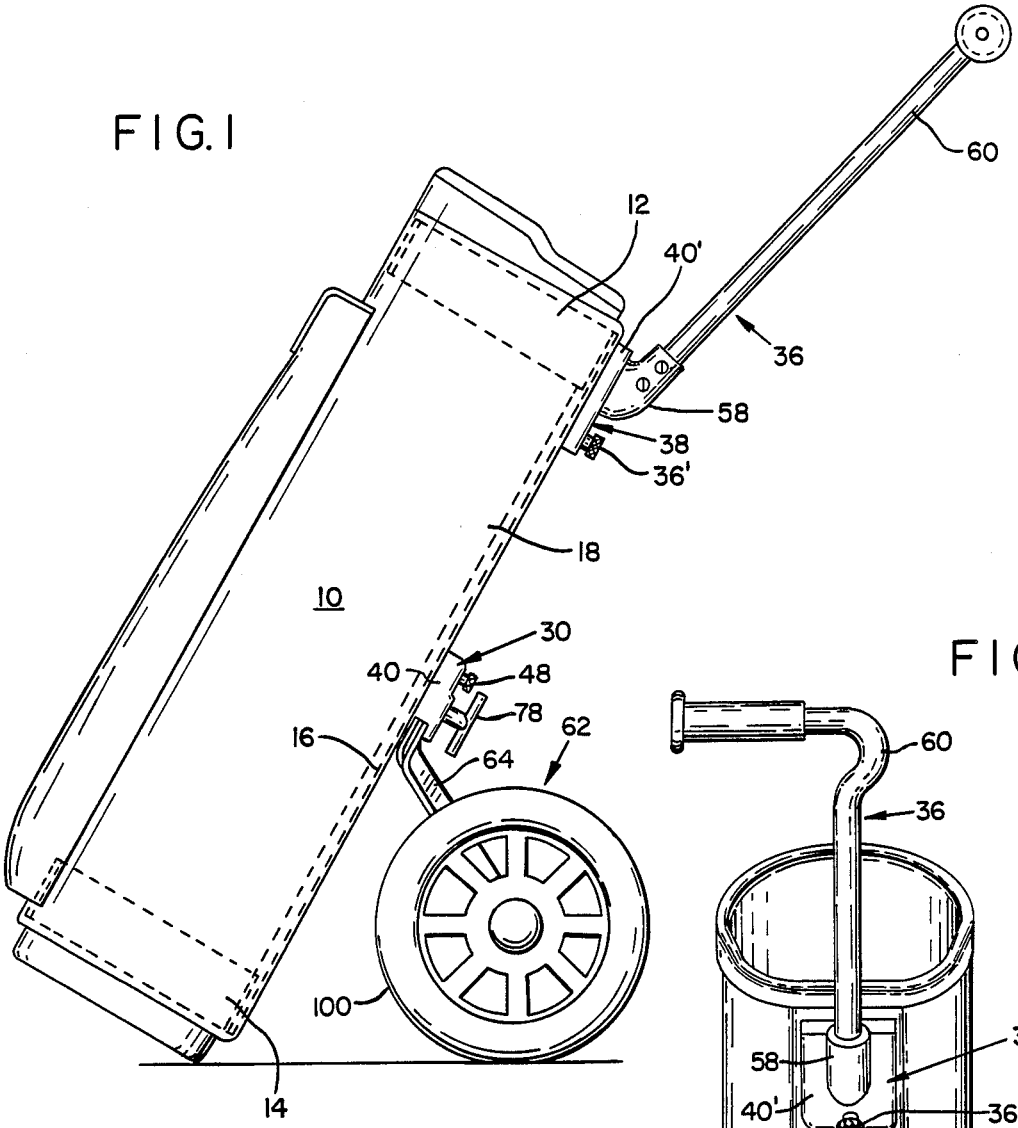
FIG. 1 is a side view of a combination golf bag and cart in accordance with the present invention.
Figure 2:
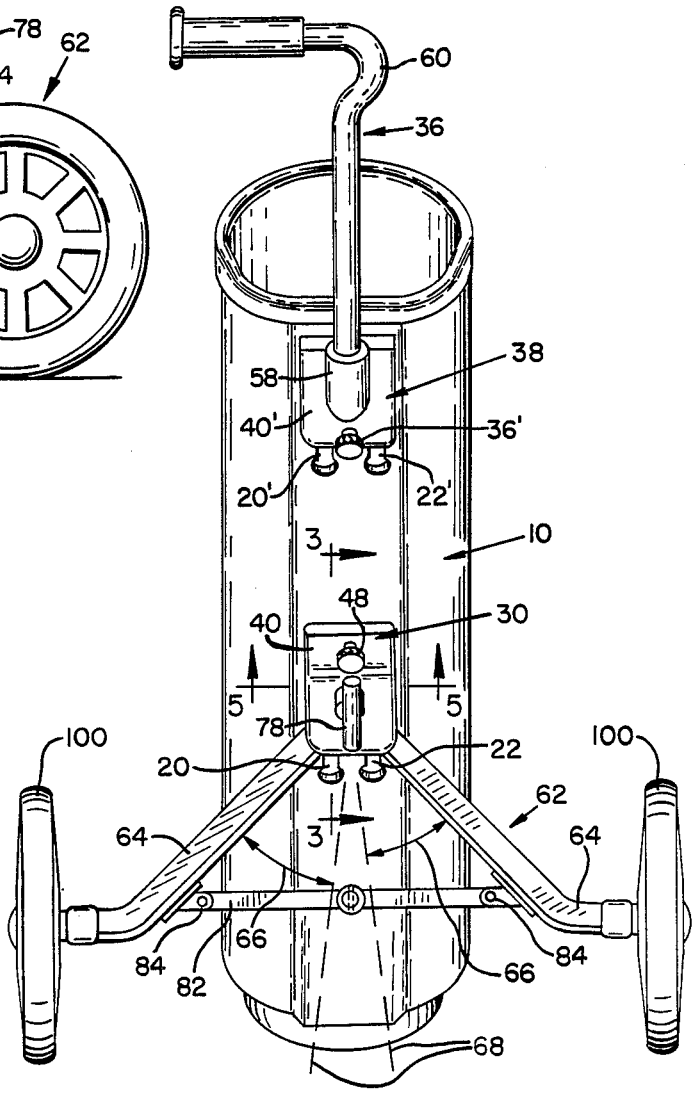
FIG. 2 is a rear view of the combination bag and cart of FIG. 1.

Referring to FIGS. 1 and 2, a golf bag 10 is somewhat typical of golf bags available in the market place with the exception of the frame portion shown in dash lines in FIG. 1. This frame portion includes an upper support ring 12, a lower support ring 14 and a spine member 16 extending between the upper and lower support rings 12 and 14. It will be appreciated that the upper and lower ring and the spine member form an integral part of the bag portion of the 10 that functions as a golf club holder having a golf club enclosing wall. A bag material 18 of whatever selection (plastic, cloth, leather) is attached to these elements in a conventional manner to provide an outside covering of the club enclosing wall. Whereas a support frame is common for golf bags, in the present instance the frame elements provide a further function. The spine member 16 (supported by the support rings 12 and 14) doubles as a main support for a cart which will now be described.

Figure 3:
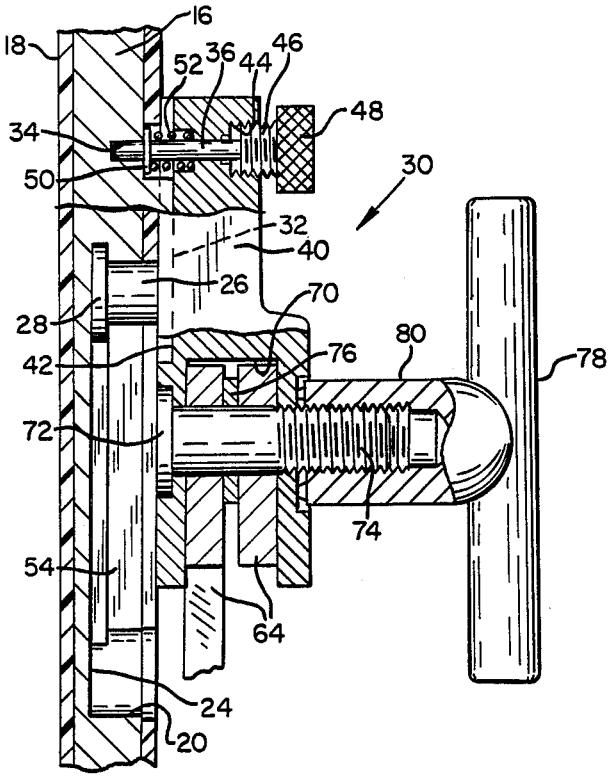
FIG. 3 is a section view of an interlock mechanism as taken on view lines 3—3 of FIG. 2.
Figure 4:
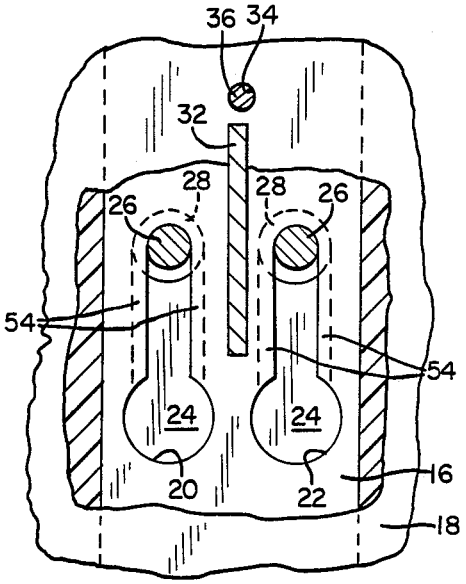
FIG. 4 is a section view as taken on view lines 4—4 of FIG. 5.
Figure 5:
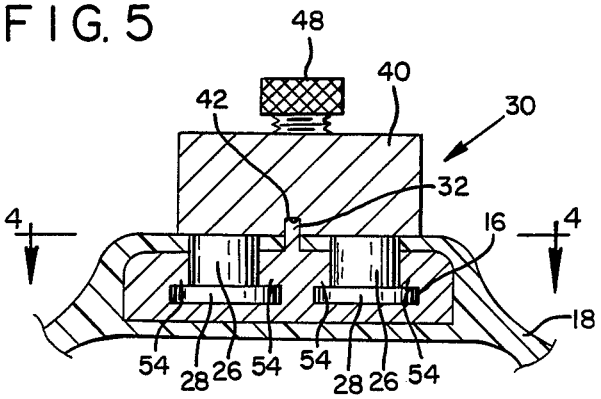
FIG. 5 is a partial section view as taken on view lines 5—5 of FIG. 2.

Reference is now made to FIGS. 3–5. As particularly seen in FIG. 5, the spine member 16 is encased in the covering material 18 of the golf bag. With further reference to FIG. 4, (refer also to FIG. 2) at a position about one third the distance from the bottom support ring, the spine member 16 is provided with a pair of vertically aligned key configured slots 20, 22. The lower end of each slot is enlarged to form a circular entryway 24. The entryway merges into a T configuration which accomodates headed studs. Thus the studs of an interlock mechanism 30, having a shank 26 and head 28, can be inserted in the entryway 24 of the key slots 20, 22 and then slid upwardly in the slot. This sliding movement is permitted due to the diameter of the shank being smaller than the restriction of the T portions of the slots 20, 22.

As illustrated in FIGS. 3–5, positioned between the slots 20, 22 on the spine member 16, is a rib 32 for stabilizing the interlock mechanism which will be explained hereafter. Also provided in the spine member is hole 34 adapted to accomodate a lock pin 36 which will also be explained. Reference is now made to FIG. 2 where it will be noted that the lock mechanism 30 of the wheel assembly is similar to lock mechanism 38 of the handle assembly. The spine member 16 is similarly configured at the two positions to accomodate these lock mechanisms (i.e., both positions include a pair of key slots, a stabilizing rib and a lock pin hole, the lock pin hole for lock mechanism 30 being above the key slots and the lock pin hole for mechanism 38 being between the slots near the lower end). The specific details of the interlock mechanism 38 and the accomodating elements of spine member 16 are not shown in detail. Reference is made to the explanation and drawings for interlock mechanism 30 which will provide the reader with an understanding of interlock mechanism 38.

Refer to FIGS. 3 and 5 and note that the interlock mechanism 30 (forming a part of the wheel assembly) includes a block 40. Studs (26, 28) are rigidly extended from the block 40 and a notch 42 is formed in the block between the studs to slidingly engage the rib 32 of the spine member.

A small straight hole through the block 40, preceded by a larger threaded opening 44 accomodates the lock pin 36. As particularly illustrated in FIG. 3, the lock pin 36 includes a small shaft that slideingly fits the small hole in the block and a larger head portion that includes screw threads 46 that threadedly engages opening 44. A knurled exterior portion 48 on the head of the lock pin allows the user to turn the lock pin for interlocking and unlocking the threaded components of the pin and block. A collar 50 on the pin provides an anchor for a coil spring 52 which is anchored at it's other end to the block. The spring is tensioned to urge withdrawal of the pin from the hole 34 in the spine member. It will thus be appreciated that interlock mechanism 30 (similar to interlock mechanism 38) achieves interlocking engagement and disengagement with the spine member 16 as follows:

Locking pin 36 is unscrewed from its seated position as shown in FIG. 3 and thus the inwardly projected end of the pin is withdrawn into the block. The block 40 is then maneuvered to align the stud heads 28 with the entry openings 24 of the key slots 20, 22. With the heads 28 fully seated in the key slots, the block 40 is slid upwardly to force the studs into the T portions of the slots. This sliding also positions the rib 32 in slot 42 to thereby stabilize the block against lateral movement relative to the spine member. With the block fully inserted in the upper position as illustrated in FIGS. 3 and 4, the lock pin 36 is manually pushed into the opening 34 until screw threads 44-46 are engaged, whereby turning of the pin locks the pin in the inwardly extended position. The block cannot be pulled away from the spine member by reason of the stud heads 28 being under the edges 54 of the T slot. The block cannot be slid downwardly by reason of the lock pin 36 being inserted in the spine hole 34. Any "play" that is present by reason of the tolerances built into these two interlocking elements is restricted by the rib 32 and slot 42 interengagement.

Reference is not made to the handle assembly 56 shown in FIGS. 1 and 2 which, similar to that of the wheel assembly, includes a block 40', lock pin 36', studs (not shown) and rib engaging slot (not shown). The locking and unlocking interengagement of the block 40' of the handle assembly with the spine member is the same as described above for the block of the wheel assembly. Additionally, a bracket member 58 extending from block 40' attached to a handle member 60 (affixed thereto by screws as shown) to complete the handle assembly.

The wheel assembly 62 is slightly more complicated by reason of the preference for folding the leg 64 of the wheel assembly together for storage convenience (as indicated by arrows 66 and dash lines 68). Reference is made to FIG. 3 wherein the upper ends of legs 64 are illustrated in overlapping relationship, located in a cavity portion 70 of the block 40. A stud having a head 72 and a threaded shank 74 extends through the block (the head 72 being countersunk in the block) into the cavity 70 and through aligned openings in the ends of leg 64. A bearing element 76 between the leg ends permits the relative pivoting of the legs about the axis of the shank 74 of the stud (as indicated by arrow 66 in FIG. 2). A locking bar 78 has a threaded cap 80 that engages the extended end of the threaded shank 74. Turning of the cap 80 onto the shank 74 forces binding of the legs 64 to prevent relative pivoting. Thus opening and closing of the locking bar 78, locks and unlocks the relative pivotal movement of the leg 64.

Figure 6:
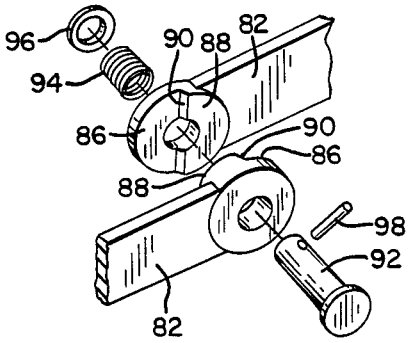
FIG. 6 is a perspective view of a brace member forming a part of the combination bag and cart of FIGS. 1 and 2.

Whereas the configuration of the cavity 70 in the block 40, and the locking of the legs 64 by the locking bar 78 restricts the positioning of legs 64, it is desirable to also provide a cross brace 82 as illustrated in FIGS. 2 and 6. Cross brace 82 is comprised of two arms pivotally connected to the two legs 64 through brackets 84. The two arms are pivotally connected together through a pivot mechanism illustrated more clearly in FIG. 6. The arm ends each include stepped bearing surfaces 86, 88 with an intermediate cam surface 90. A headed shaft 92 extends through the arm ends, through a spring 94 and a washer 96, the assembly of which is held together by pin 98. The spring 94 urges the arm ends together and when in the extended position of FIG. 2, the cam surfaces 90 are interengaged to resist relative pivoting of the arms. With force applied upwardly at the pivotal connection, the arm ends are rotated to force separating movement of the arm ends against the urging of spring 94.

OPERATION

It will be appreciated that with the bag 10 separated from rings 12, 14 and interconnecting spine member 16 functions as part of the bag frame. Although providing more than sufficient strength as a bag frame, very little extra weight is added. The bag can be easily carried in a typical fashion and although not shown, it will be appreciated that attachable carrying straps are readily provided for this purpose. Furthermore, the bag will readily accomodate the carrying racks of motorized golf carts and readily adapts to that purpose.

In the separated state, the legs 64 are collapsed with the wheels 100 folded together for compact storage. The handle assembly when detached occupies little space and can be easily tucked into a corner of the golfer's car trunk. When the golfer decides to use the cart feature, he simply aligns the wheel assembly studs with the slots 20, 22, slides the assembly up into place and pushes in and turns the locking pin 36. The handle assembly is attached in the same way to the upper slots 20', 22'. The locking bar 78 is then opened and the wheels pulled apart as permitted by full extension of cross brace 82, at which point the center pivot mechanism locks into place (but subject to manual buckling force). The locking bar 78 is then retightened and the golfer has the golf bag mounted to a pull cart, easily equivilent in handling to that of a conventional pull cart.

It is the inventor's belief that no one has heretofore provided a golf bag having a rigid frame portion of the bag that doubles as the frame of a pull cart by the attachment of wheel and handle assemblies. Having access to the teaching herein, others skilled in the art will conceive of numerous variations and modifications without departing from the concept of the invention. Accordingly, the patent coverage granted herein is not limited to the described embodiment but encompasses such variations and modifications as defined by the Claims appended hereto.

What is claimed is:

1. A combination golf bag and removable golf bag holder comprising; a golf bag including a golf club holder portion with golf club enclosing side wall, a vertically extended rigid spine member forming an integral part of the golf club holder portion and confined within said enclosing side wall, a removable golf bag holder assembly with a pair of supporting wheels, and quick release, manually actuated fastening means having a protruding head portion forming a part of the holder assembly, said rigid spine member provided with a configured slot mated with a protruding head portion for rapid manual interlock, said configured slot within the confines of the enclosing wall engaged by the manually actuated releasable fastening means of the holder assembly whereby the holder assembly is manually releasably fastened to the rigid spine member for conversion of the combination golf bag from a golf bag-pull cart assembly to a carrying golf bag free of obtrusions.

2. A combination golf bag and removable golf bag holder as defined in claim 1 wherein a handle is attached to the spine member independent of the golf bag holder so that the spine member within the golf club enclosing wall functions to interconnect the handle to the wheel assembly at spaced positions along the length of the spine member.

3. A combination golf bag and removable golf bag holder as defined in claim 2 including a second manually releasable fastening means forming a part of the handle, and a second fastener receiving means on the spine member within the confines of the enclosing wall, said releasable fastening means releasably fastening said handle to the spine member.

4. A combination golf bag and removable golf bag holder as defined in claim 3 wherein the holder assembly comprises a pair of legs pivotally connected at one end, wheels carried by the opposite end of each leg, said legs being selectively pivotable about their pivotal connection for folding and unfolding the wheels, and releasable lock means to lock the legs against pivoting.

5. A combination golf bag and removable golf bag holder as defined in claim 4 wherein said releasable fastening means comprises a block, a headed stud projected from the block, and a retractable lock pin projected from said block, and the fastener receiving means of the rigid spine member comprises a key slot having an opening for receiving the headed stud and a T portion, said stud being slidable in said slot to a position in the T portion of the slot where separation of the block from the spine member is prevented, said spine member having a pin receiving opening aligned with said lock pin in said position whereby insertion of the pin prevents reverse sliding of the stud in the slot.

6. A combination golf bag and removable golf bag holder as defined in claim 5 wherein each of said releasable fastening means and said second releasable fastening means comprises a block, a headed stud projected from the block, and a retractable lock pin projected from said block; and each of the fastener receiving means of the rigid spin member comprises a key slot having an opening for receiving the headed stud of the respective releasable fastening means of the holder assembly and handle, and a T portion formed in said key slot, said respective stud being slidable in said slot to a position in the T portion of the slot where separation of the block from the spine member is prevented, said spine member having a pin receiving opening aligned with said lock pin in said position whereby insertion of the pin prevents reverse sliding of the stud in the slot.

* * * * *